US007654576B2

(12) United States Patent
Silverman

(10) Patent No.: US 7,654,576 B2
(45) **Date of Patent: *Feb. 2, 2010**

(54) STRETCHABLE FABRIC BOOK COVER AND METHOD

(75) Inventor: Robert S. Silverman, LaMirada, CA (US)

(73) Assignee: Kittrich Corporation, La Mirada, CA (US)

( * ) Notice: Subject to any disclaimer, the term of this patent is extended or adjusted under 35 U.S.C. 154(b) by 83 days.

This patent is subject to a terminal disclaimer.

(21) Appl. No.: 11/861,377

(22) Filed: Sep. 26, 2007

(65) Prior Publication Data

US 2008/0067799 A1 Mar. 20, 2008

Related U.S. Application Data

(63) Continuation of application No. 11/157,006, filed on Jun. 20, 2005, now Pat. No. 7,290,801, which is a continuation-in-part of application No. 10/177,964, filed on Jun. 24, 2002, now abandoned.

(51) Int. Cl.
*B42D 3/04* (2006.01)

(52) U.S. Cl. ..... 281/34; 281/15.1; 281/29; 281/31

(58) Field of Classification Search ..... 281/2, 281/3.1, 5, 15.1, 29, 51, 19.1, 34; D19/26, D19/27

See application file for complete search history.

(56) References Cited

U.S. PATENT DOCUMENTS

| | | | | |
|---|---|---|---|---|
| 913,036 | A | 2/1909 | Reynolds | |
| 1,479,791 | A | 1/1924 | Degenring | |
| 1,540,297 | A | 6/1925 | Walraven | |
| 1,595,002 | A | 8/1926 | Davis | |
| 2,057,987 | A | 10/1936 | Walraven | |
| 2,311,153 | A * | 2/1943 | Carlo | 281/34 |
| 2,753,194 | A | 7/1956 | Correa | |
| 3,222,085 | A | 12/1965 | Young | |
| 3,835,746 | A * | 9/1974 | Young et al. | 83/346 |

(Continued)

FOREIGN PATENT DOCUMENTS

| | | |
|---|---|---|
| GB | 683885 | 10/1952 |

(Continued)

*Primary Examiner*—Dana Ross
*Assistant Examiner*—Jamila Williams
(74) *Attorney, Agent, or Firm*—Patentmetrix

(57) ABSTRACT

A flexible, preferably elastic empanelled book cover (12) that has pocket portions (25) to receive the covers of a book (10) that is inserted therein. The cover (12) consists of a unitary hexagonal sheet of pliable material such as "SPANDEX", having extended upper and lower edges, with each edge bisected by a slot (32) of predetermined width that extends orthogonally. Fold lines (34, 36 and 38) form a laterally-extended rectangle, with the side fold lines (38) forming the lateral apices of the hexagon two triangular flap portions (20) of the cover pockets. The in-folded upper and lower flap portions of the hexagon are attached to each other and to the triangular side flap portions, to form the pocket portion (25), with lock stitching (27) at the innermost juncture by the spine opening. A central top and bottom fold-over engages the spine of the book in stabilizing relation. The unitary hexagonal blanks can be economically mass produced from roll material (40).

7 Claims, 5 Drawing Sheets

U.S. PATENT DOCUMENTS

| | | | | |
|---|---|---|---|---|
| 3,905,848 | A | 9/1975 | Williams | |
| 4,519,630 | A | 5/1985 | Holmes | |
| 4,541,364 | A | 9/1985 | Contello | |
| 4,715,619 | A | 12/1987 | Sloot | |
| 4,744,592 | A | 5/1988 | Barnette et al. | |
| 4,893,979 | A | 1/1990 | Alpers | |
| 5,004,514 | A | 4/1991 | Pugliese et al. | |
| 5,013,068 | A | 5/1991 | Maldonado | |
| 5,029,900 | A | 7/1991 | Axelrod | |
| 5,056,663 | A | 10/1991 | Ostrowski | |
| 5,092,630 | A | 3/1992 | Ostrowski | |
| 5,158,325 | A | 10/1992 | Landis | |
| 5,207,717 | A | 5/1993 | Manning | |
| 5,209,624 | A | 5/1993 | Nicolaisen | |
| 5,219,437 | A | 6/1993 | Moor | |
| 5,470,109 | A | 11/1995 | Grande | |
| 5,535,506 | A | 7/1996 | Chalfin | |
| 5,616,387 | A * | 4/1997 | Augst et al. | 428/43 |
| 5,851,031 | A | 12/1998 | Golson | |
| 5,992,886 | A | 11/1999 | Udd | |
| 6,257,622 | B1 | 7/2001 | Peker | |
| 7,290,801 | B2 | 11/2007 | Silverman | |
| 7,334,819 | B2 | 2/2008 | Silverman | |
| 7,478,837 | B2 * | 1/2009 | Silverman | 281/36 |
| 2003/0234531 | A1 | 12/2003 | Silverman | |
| 2004/0066031 | A1 | 4/2004 | Wong | |
| 2006/0091668 | A1 | 5/2006 | Silverman | |
| 2007/0085329 | A1 | 4/2007 | Silverman | |

FOREIGN PATENT DOCUMENTS

| | | |
|---|---|---|
| WO | WO2006/110959 | 4/2006 |

* cited by examiner

STRETCHABLE FABRIC BOOK COVER AND METHOD

CROSS REFERENCE TO RELATED APPLICATION

This application is a continuation of U.S. patent application Ser. No. 11/157,006, filed on Jun. 20, 2005 and issued as U.S. Pat. No. 7,290,801 on Nov. 6, 2007, which is a continuation-in-part of U.S. patent application Ser. No. 10/177,964 filed Jun. 24, 2002, now abandoned.

TECHNICAL FIELD

This invention generally pertains to adjustable book covers, and more particularly to a protective elastic fabric covering which easily conforms to a variety of book sizes. Specifically, the invention features an improved construction and a method for fabricating an adjustable fabric sleeve that snugly envelops the exterior paperboard panels and spine of a book.

BACKGROUND ART

Numerous book covers have been devised to protect schoolbooks and other hard covered texts from moisture or grime. Many of these coverings utilize Kraft paper wrappings or are fabricated from more durable plastic materials. The application of book covers typically requires the time consuming steps of trimming the covering to size, fashioning and folding flaps, and then inserting the front and back panels of a bound book into lateral envelopes formed by the flaps. Adhesive tape may also be required to secure the protective covering into position, which will often mar a text when removed. Some conventional plastic book covers are similarly available with a coating of repositionable pressure sensitive adhesive. Although intended to removably cling to the exposed surfaces of a book, such coverings are known to become troublesome to remove after long term usage. Alternatively, stretchable fabric covers which have attempted to remedy the problems of paper and plastic sleeves fall short of uniformly protecting the vulnerable surfaces of a book.

A search of the prior art did not disclose any patents that read directly on the claims of the instant invention, however the following U.S. patents are considered related:

| PATENT NO. | INVENTOR | ISSUE DATE |
|---|---|---|
| 5,004,514 | Pugliese et al | Apr. 2, 1991 |
| 5,013,068 | Maldonado | May 7, 1991 |
| 5,029,900 | Axelrod | Jul. 9, 1991 |
| 5,056,663 | Ostrowski | Oct. 15, 1991 |
| 5,092,630 | Ostrowski | Mar. 3, 1992 |
| 5,470,109 | Grande | Nov. 28, 1995 |
| 5,158,325 | Landis et al. | Oct. 27, 1992 |
| 5,209,624 | Nocolaisen | May 11, 1993 |
| 5,219,437 | Moor et al | Jun. 15, 1993 |
| 6,257,622 | Peker | Jul. 10, 2001 |

U.S. Pat. No. 5,004,514 issued to Pugliese et al. discloses a method of making a protective book covering comprising a relatively long piece of plastic sheet material and a relatively short piece of plastic sheet material overlying the long piece. The longitudinal edges of the two sheets are heat sealed together, and there is an alternative option of applying a strip of adhesive to secure one of the longitudinal edges.

U.S. Pat. No. 5,013,068 issued to Maldonado discloses a protective envelope for a book comprising a stretchable sheet of compressible synthetic polymer fabric and a relatively thick layer of closed-cell elastomeric compressible foam that is lined on one side. The stretchable composite sheet may comprises neoprene foam and stretchable nylon, with the foam having a thickness of approximately 1/32-inch to 1/16-inch.

U.S. Pat. No. 5,029,900 issued to Axelrod discloses a wrap-around plastic cover for a bound book that is formed from a rectangular sheet having a center portion that abuts the book spine, with end portions of the sheet folded inward to enclose the front and rear covers of the book. The distal portions of the rectangular sheet thus form inward-facing flaps to receive the front and rear covers of the book as a removable cover.

U.S. Pat. Nos. 5,056,663 and 5,092,630 issued to Ostrowski disclose adjustable protective book covers having similar features. The Ostrowski '663 patent discloses an adjustable cover having releasable hook and loop fasteners or adhesives which serve to secure a book within the cover. The Ostrowski '630 patent discloses a one-size-fits-all book cover which comprises sheet material having folded over top and bottom edges, and sides with short hems. The side edges are folded over to form side pockets for insertion of the covers of a book therein.

U.S. Pat. No. 5,470,109 issued to Grande discloses an adjustable book cover made of SPANDEX material which is cut in a unique diamond shaped pattern wherein two diagonal stitched seams converge to form the apex of a triangle for inserting the book's front and back book covers.

U.S. Pat. No. 5,158,325 issued to Landis et al. discloses an adjustable book cover similar to that taught by Grande, except that the book cover forms pockets with a sinusoidal stitched seam at the lip of the insert portion of the cover.

U.S. Pat. No. 5,209,624 issued to Nocolaisen discloses a method for interconnecting two sheets or plates for covering a book. The cover comprises an adhesive layer applied to a narrow zone that extends along the adjacent ends of the plates. An adjoining portion of each plate is folded inward along a folding line to define an acute angle, with the longitudinal axis of the protective strip such that the free end portion of the protective strip extends beyond the edge of the sheet to form a gripping end.

U.S. Pat. No. 5,219,437 issued to Moor et al. discloses a fabric covered book cover comprising a front leaf board, a back leaf board, and a spine having a plurality of integral ridges formed therein to promote foldability. The inner and outer surfaces of the cover are covered by woven nylon or other synthetic material.

U.S. Pat. No. 6,257,622 issued to Peker discloses a cloth book cover that is preferably made of SPANDEX. The cover has end pockets to receive the front and back covers of a book that is inserted therein. The top and bottom edges of the cover are stitched, the protruding portions of which tend to promote local wear. The formation of the end pockets requires extension of the cover material when inserting a book within the cover.

None of the above inventions and patents, taken either singly or in combination, is seen to describe the instant invention as herein claimed.

DISCLOSURE OF THE INVENTION

The present invention provides a flexible empanelled book cover having pocket portions to receive the paperboard covers of a book that is inserted therein. The cover pocket portions provide an access slot, which is parallel with the spine of the book, to facilitate insertion of the covers of a book within the pocket portions of the book cover.

The book cover consists of a unitary hexagonal sheet of pliable material with extended upper and lower edges, which are each bisected by a slot of predetermined width, which extends at right angles to the respective edge. The hexagonal blank contains four fold lines in the form of a laterally-extended rectangle, wherein the shorter side fold lines, in conjunction with adjoining side faces of the hexagonal blank, define triangular flap portions of the cover pockets.

The longer side fold lines, in conjunction with the respective upper and lower adjoining sections of the hexagonal blank, define upper and lower flap portions which, when folded, abut the triangular side flap portions to which they are joined together. This attachment positions the horizontal edges of the hexagonal blank in a mutually adjoined relation, thus providing two reciprocally aligned access apertures, by way of which the book is inserted into the protective cover. The bisecting slots do not intersect the fold lines. Rather, the vertices of the slots are positioned away from the respective fold lines by a predetermined amount, thereby creating a fold-over when folded along the fold line. The fold-over engage the ends of the spine of the book in a stabilizing relation.

The present invention further provides a method for manufacturing a book cover from a sheet of pliant material, including the steps of: cutting a laterally-elongated, substantially symmetrical hexagon from a sheet of material; cutting a slot in each laterally-elongated side in a substantially bisecting relation therewith, the slots extending at right angles to the respective elongated sides, and extending a predetermined distance into the hexagon; creating laterally-extended fold lines, and end fold lines orthogonal thereto, to form a rectangle having the corners thereof coincident with the four shorter sides of the hexagon; folding inward the portions of the hexagon that are located external to the rectangle to bring the edge portions of the hexagon into a mutually adjoining relation, and securing the adjoining edge portions together, thereby forming two pockets to receive, conceal and protect the exposed covers of a book.

In the described method, the bisecting slots may be cut to extend adjacent to, but not to intersect, the laterally-extending fold lines. The subsequent folding of the upper and lower sections of the hexagon about the laterally extending fold lines creates a pair of central flaps. The flaps engage and stabilize the ends of the spine of a book when inserted within the protective cover.

The present invention may be cut from SPANDEX material, or other fabric materials composed of stretchable elastic threads, such as nylon. When SPANDEX material is utilized, the slot may have a width of one centimeter. When nylon is utilized, the slot width is increased to as much as four centimeters in order to avoid overstressing the nylon material. Additionally, the horizontal joints of the upper and lower flaps each comprise a row of stitching, including lock-stitching, that is applied at the innermost ends to withstand the stresses applied when the cover is stretched during the insertion of a book within the cover.

The described method also includes laying out and cutting a plurality of the hexagonal blanks in a mutually nested relation, thus permitting the simultaneous cutting of the bisecting slots, for two adjoined rows of hexagons, as a single slot. Further, adjacent hexagonal blanks that share adjoining peripheral edges are also cut during the same procedure.

These and other objects and advantages of the present invention will become apparent from the subsequent detailed description of the preferred embodiment and the appended claims taken in conjunction with the accompanying drawings.

BRIEF DESCRIPTION OF THE DRAWINGS

Certain embodiments of the invention are described by way of illustration without limitation thereto, other than as set forth in the accompanying claims, reference being made to the accompanying drawings, wherein:

BEST MODE FOR CARRYING OUT THE INVENTION

Figure 1:
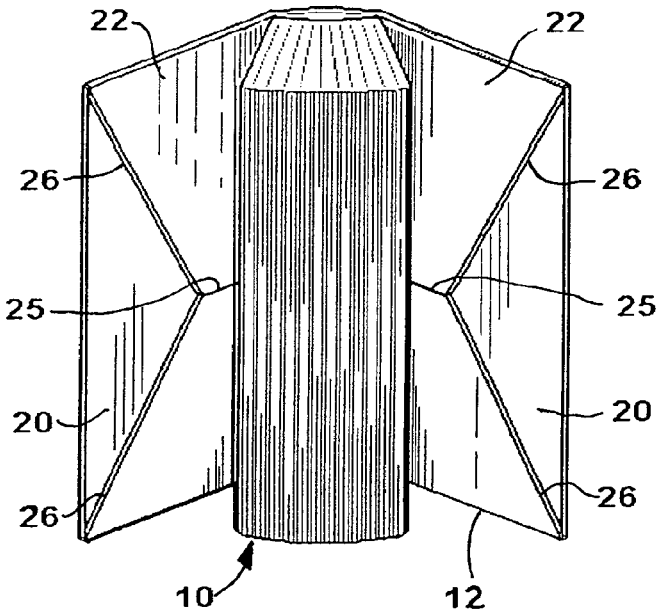
FIG. 1 is a front perspective view showing a book standing on its bottom edge, having the partially open covers of the book concealed within a book cover in accordance with the present invention.
Figure 2:
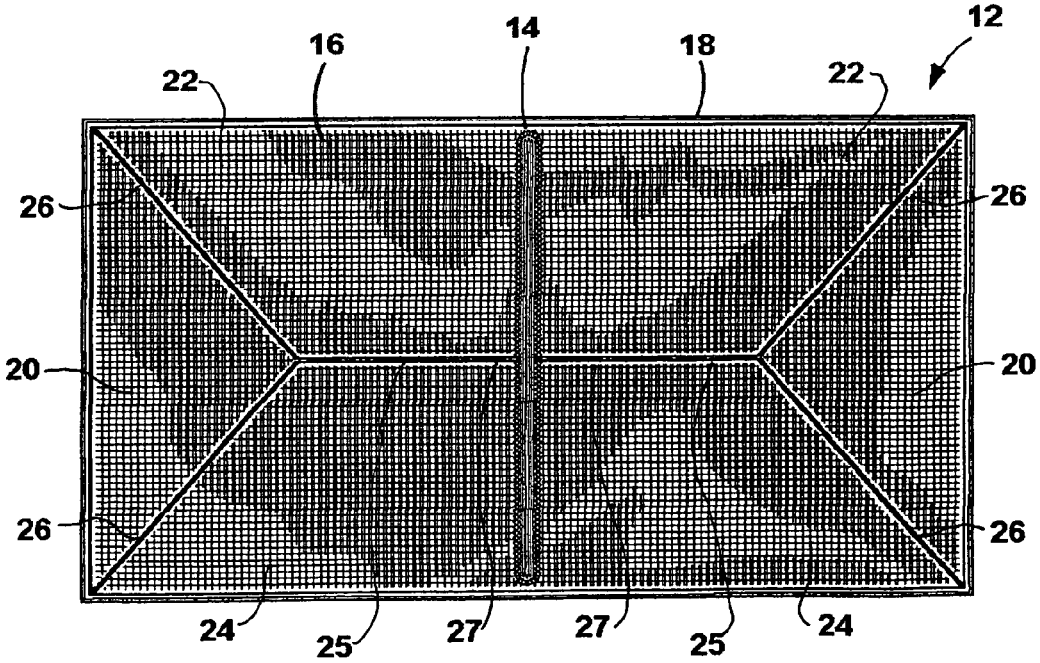
FIG. 2 is an interior plan view of the book cover in an open configuration.

The best mode for carrying out the invention is presented in terms of a preferred embodiment of a book cover 12, as shown in FIGS. 1-7. A book 10, as shown in FIG. 1 has covers which are contained within and concealed by the book cover 12. As shown in FIG. 2, the book cover 12 has outer panel portions extending from a spine cover portion 14 that is laterally bounded by a left front cover portion 16, for the book front cover, and a right rear cover portion 18 to receive the book back cover. The cover 12 consists of a plurality of panels in a mutually folded-in edge secured relationship.

The cover 12, as shown in FIG. 2, has triangular edge panel portions 20, top edge panels 22 and bottom edge panels 24, which all form the interior of the book cover 12. The top edge panels 22 interface with the bottom edge panels 24, thereby forming between them two pockets 25. The pockets 25 are comprised of lines of stitching 26 that provide the means of insertion for the covers of a book 10 into the book cover 12. The innermost junctures of the top panels 22 and the bottom panels 24 are secured by locking stitches 27. The side edges of the panel portions 20, 22 and 24 are preferably connected by rows of stitching 26. Alternative forms of connection such as taping and/or gluing, ultrasonic welding or R.F welding, or heat sealing can also be utilized. The stitched seams may be made with interlocking stitching, which can be substantially concealed by turning the cover 12 inside out, whereby the stitching is contained within the pocket portions of the book cover 12.

Figure 3:
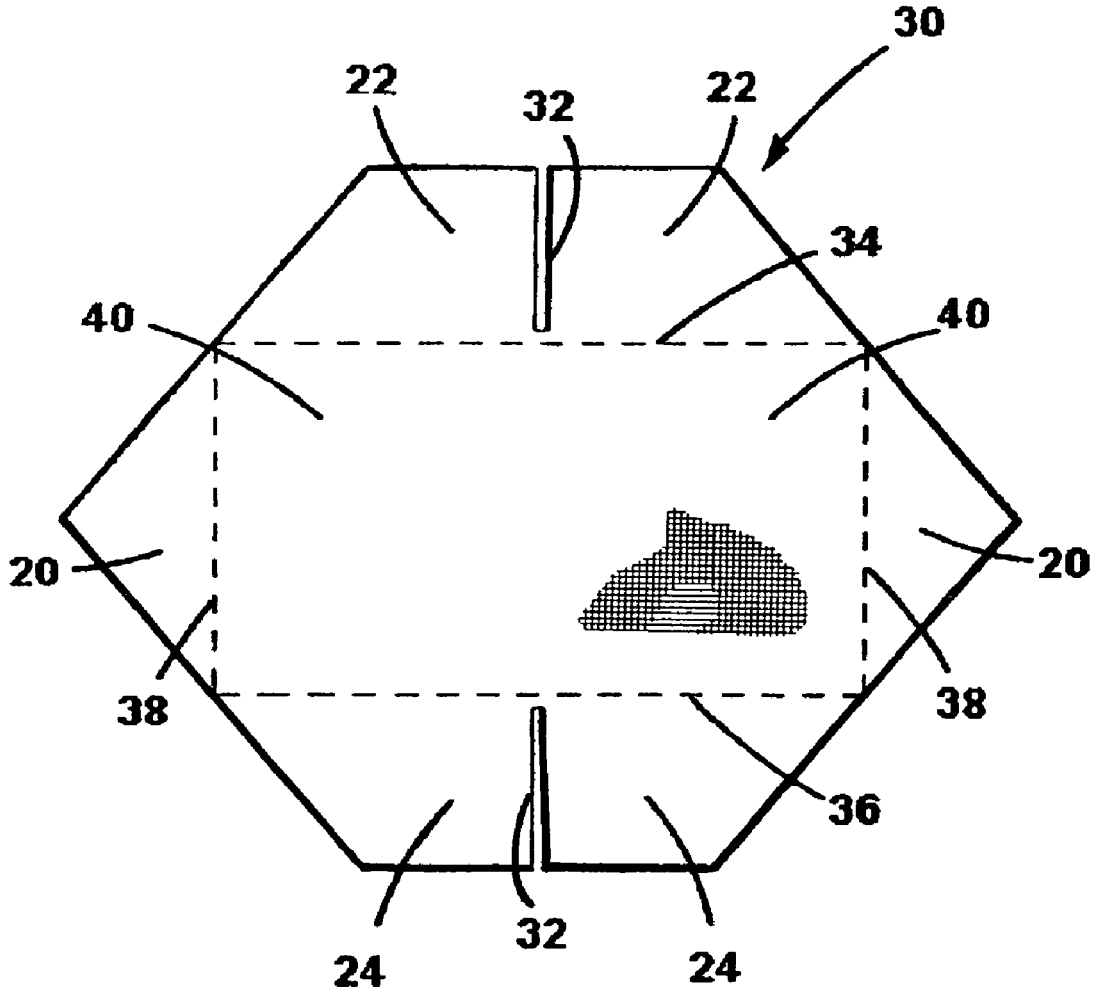
FIG. 3 is a plan view (to a different scale) of the panels of the FIG. 2 embodiment in an unfolded, unstitched condition.

As shown in FIG. 3, a cover blank 30 is an unequal hexagon having slots 32 of predetermined length in its top and bottom edges. A top fold line 34 and a bottom fold line 36, along with side fold lines 38, form the bounds of the cover outer panel 40, which includes the intermediate spine area. The fold lines 34, 36 and 38 define one side of each of the panels 20, 22 and 24. It should be noted that the bottom or inner portion of each slot 32 does not reach the respective fold lines 34, 36. As a result, top and bottom turn-over portions of the cover 12 are created, which overhang and engage the top and bottom portions of the book spine. This serves to stabilize the book within the cover 12.

Figure 4:
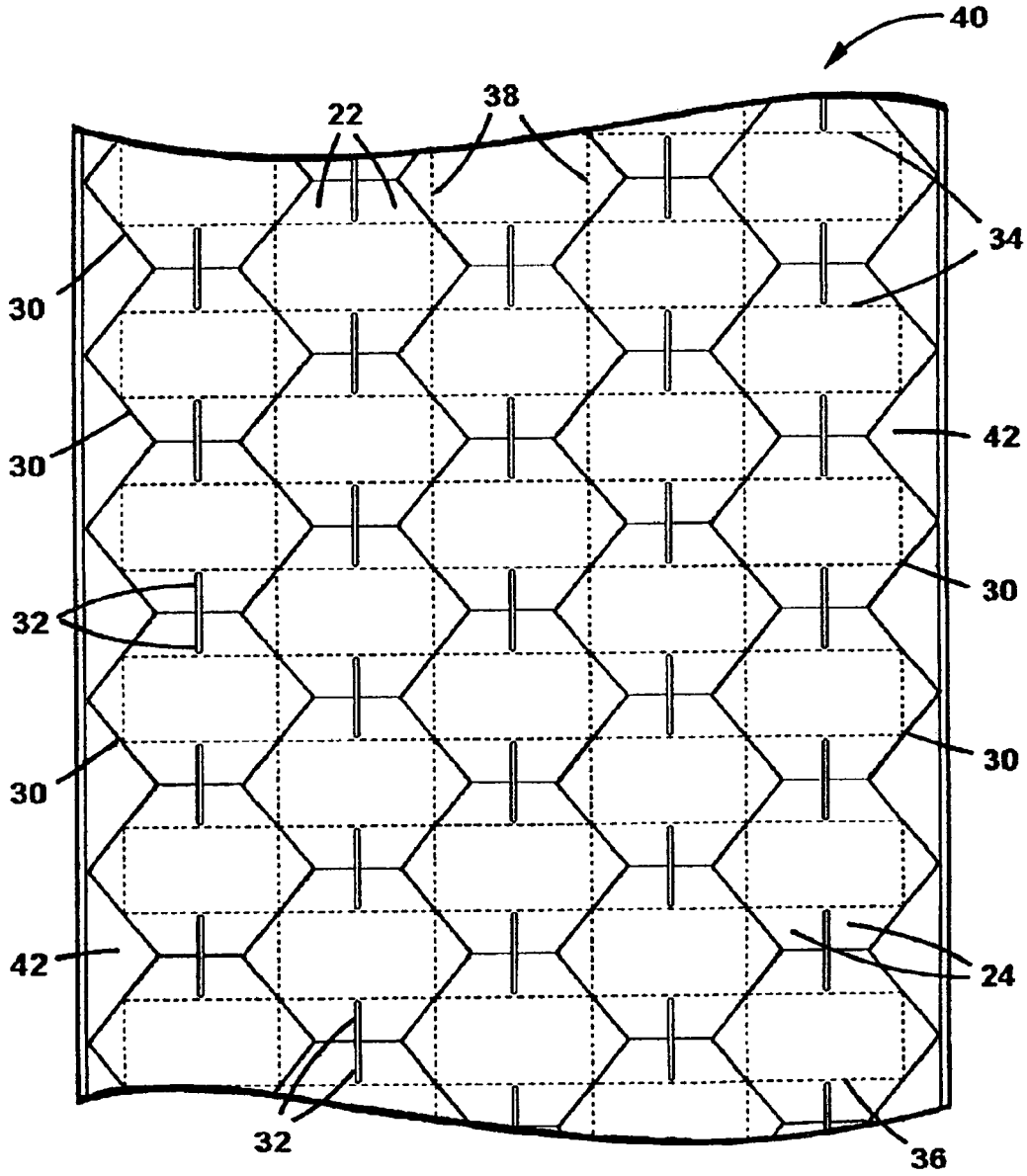
FIG. 4 is a plan view of a portion of a sheet of pliant material showing the cut and fold lines for the mass production of the subject book covers.

As shown in FIG. 4, a roll of material is marked and cut. The illustrated portion 40 shows twenty three complete cover blanks 30, with the fold lines shown dotted, to facilitate recognition of the respective blanks 30. It should be noted that a comparatively small amount of selvedge 42 is involved. The preferred pliable material is SPANDEX or a material made of stretchable elastic threads. Additionally, a plastic material such as an elastomeric film or a stretchable fabric coated with an elastomeric resin can also be utilized.

Figure 7:
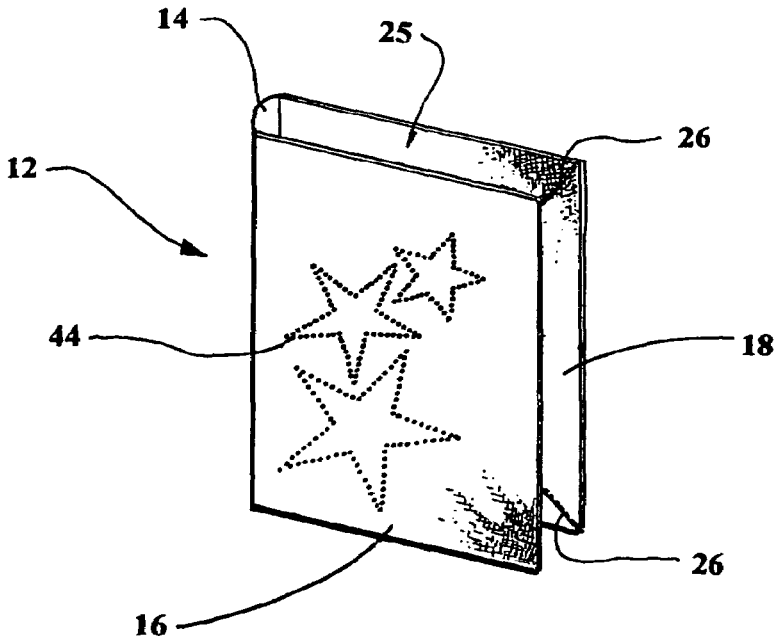
FIG. 7 is a partial isometric view of the outside of the book cover with rhinestone/nail head transfer indicia on the front arranged in the form of a star design.

For aesthetic qualities and to enhance the overall appearance of the book cover 12 the outer panel portions may include indicia. For example, the indicia can comprise a plurality of rhinestone or nail head transfers 44 that are arrayed in sequence, thus forming a design or motif on either the front or rear outer panel portion. The rhinestone or nail head transfers 44 are applied to the outer surface of the left front cover portion 16 and/or the right rear cover portion 18, and infused in place with a heat transfer press. FIG. 7 shows a representative design in an form of the outline of a number of stars.

The method of manufacturing the book cover 12 is basically the same as described in detail above and consists of the steps of cutting the cover blank 30 in a hexagonal shape and cutting slots 32 in the elongated sides 22 and 24. Fold lines 34, 36 and 38 are created to form a rectangle, and the adjoining edge portion of the hexagon are secured to form two pockets to receive the covers of a book. The cutting steps are selected from the group consisting of cutting by rule and rotary dies, rule and rotary dies with heating, and rule and rotary dies with ultrasonic energy. Further, the blank material 30 may be cut into the hexagonal shape from a roll of material, as described above and illustrated in FIG. 4. The method consists of laying out and cutting a plurality of hexagonal blanks in adjoining rows having respective hexagons in mutually nested relation, and simultaneously cutting the bisecting slots of two adjoined hexagons as a single slot.

Figure 5:
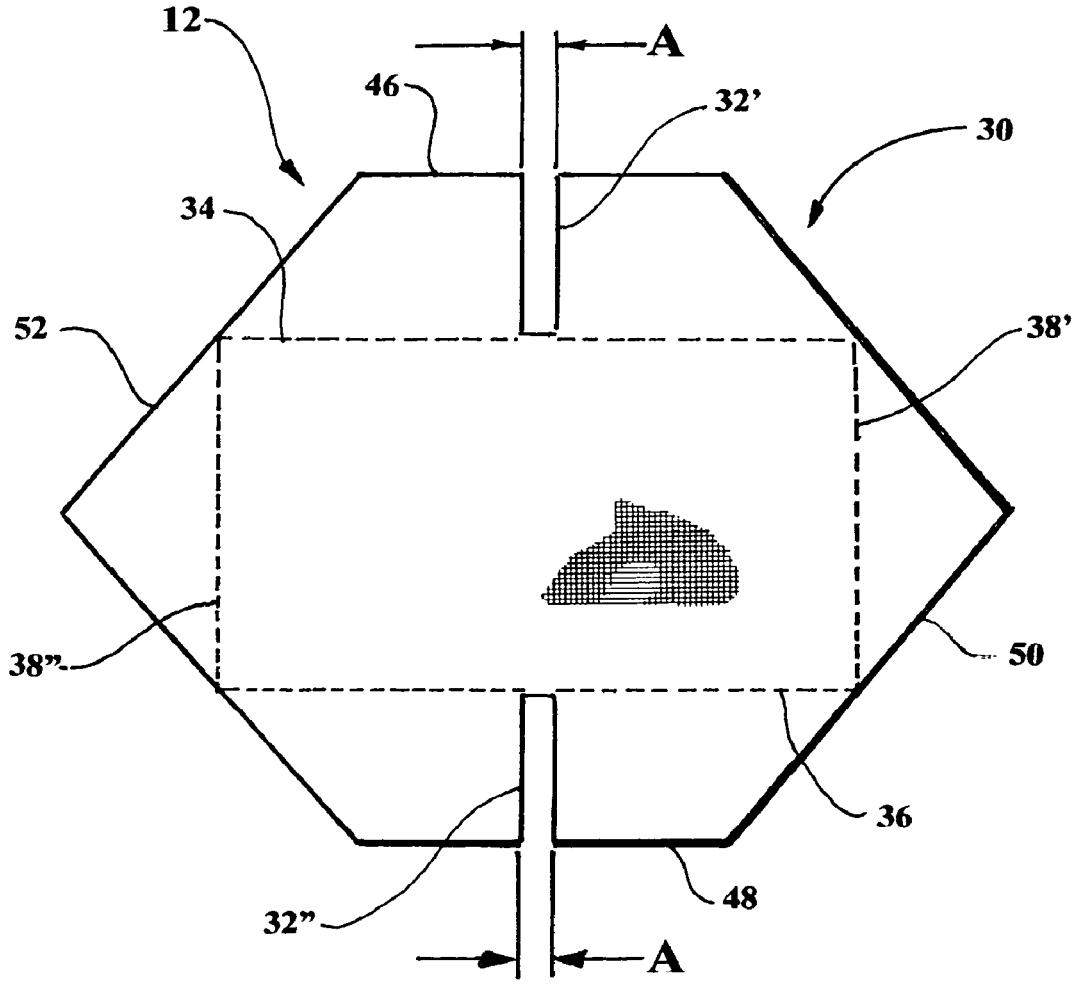
FIG. 5 is a plan view of the cover blank with the fold lines and width of the slots illustrated.

Referring to FIG. 5, the book cover 12 is illustrated in the flat prior to folding and consists of the cover blank 30 in the form of an unequal hexagon of pliable material having a top edge 46, a bottom edge 48, an angular right side edge 50 and an angular left side edge 52, with each edge 46-52 in opposed parallel relationship.

The top edge 46 has a first slot 32', while the bottom edge 48 includes a second slot 32", with each slot 32', 32" bisecting the edge 46 and 48, and extending inward at right angles to the edges 46 and 48. The slots 32' and 32" have a width of from 1 centimeter to 4 centimeters at a predetermined depth. The width of the slots 32' and 32" is indicated with the alpha designation "A" in FIG. 5.

Figure 6:
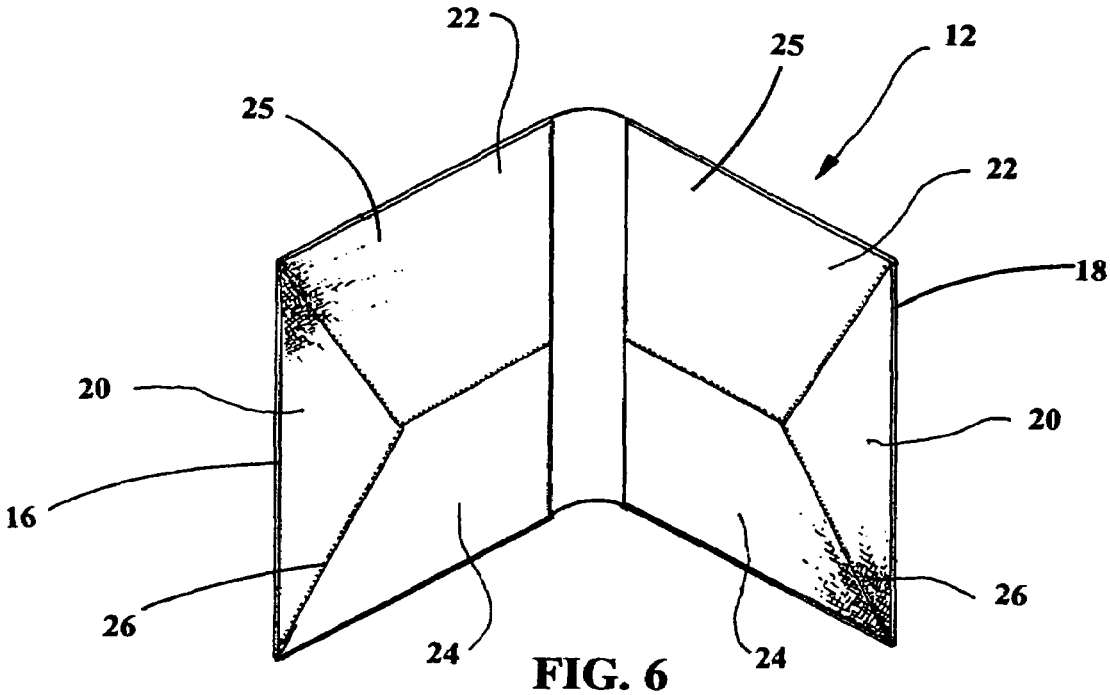
FIG. 6 is a front perspective view of the book cover in an open position as viewed from its inner surface illustrating the stretchable elastic thread material.

A top fold line 34 is formed by preferably creasing the material between the angular right edge 50 and the angular left side edge 52 parallel with the top edge 46 and bordering the terminal end of the first slot 32'. When the cover blank 30 is doubled over the top cover fold line 34, a pair of top edge panels 22 are formed, as shown in FIG. 6.

A bottom fold line 36 is formed in like manner between the angular right side edge 50 and the angular left side edge 52 parallel with the bottom line 48 and bordering the terminal end of the second slot 32". When the cover blank 30 is doubled over the bottom cover fold line 36, a pair of bottom edge panels 24 are formed, as shown in FIG. 6.

A right side fold line 38' and a left side fold line 38" are formed parallel with each other. When the material is doubled over the fold lines 38' and 38", a pair of triangular edge panels 20 are formed, as also shown in FIG. 6.

Fastening means for attaching the top edge panels 22, bottom edge panels 24 and triangular edge panels 20 together to form pockets are defined as locking stitches 27, preferably by rows of stitching 26 or alternatively taping, gluing, ultrasonic/R.F welding, or heat sealing. It should be noted that the first slot 32' and second slot 32" provide sufficient span to accommodate the spine of the book 10.

While the invention has been described in detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

The invention claimed is:

1. A method for manufacturing a book cover from a sheet of pliant material comprising the steps of: cutting a laterally-elongated polygon from a sheet of said pliant material, cutting a slot in each laterally-elongated side in a substantially bisecting relation therewith, the slots extending at right angles to the respective elongated sides, and extending a predetermined distance into the polygon; creating laterally-extended fold lines and end fold lines orthogonal thereto to form a rectangle having rectangle corners thereof coincident with the sides of the polygon, folding inward the portions of the polygon that are located external to the rectangle to bring the edge portions of the polygon into mutually adjoining relation, wherein said portions of the polygon that are located external to the rectangle include a lateral triangular panel, a top panel having at least four sides, and a bottom panel having at least four sides, and securing said adjoining edge portions together, wherein a bottom edge of said top panel is joined to a top edge of said bottom panel, a side edge of said top panel is joined to a side edge of said lateral triangular panel, and a side edge of said bottom panel is joined to a side edge of said lateral triangular panel to thus form an access slot and two pockets, wherein each pocket comprises a lateral triangular panel, a top panel having at least four sides, and a bottom panel having at least four sides and wherein said access slot provides access through which interiors of said front cover pocket and said back cover pocket can be accessed.

2. The method as specified in claim 1 wherein said cutting step is selected from the group consisting of cutting by rule and rotary dies, rule and rotary dies with heating, and rule and rotary dies with ultrasonic energy.

3. The method as specified in claim 1 wherein said slots are cut to extend adjacent in non-intersecting relation with said laterally extending fold lines, wherein upon the folding upper and lower portions of said polygon about the lateral-extending fold lines, a pair of central flaps are created, which engage in stabilizing relation with the ends of the spine of a book when the book is inserted within the cover.

4. The method as specified in claim 1 further comprising the step of laying out and cuffing a plurality of polygonal blanks in adjoining rows having respective polygons in mutually nested relation, and simultaneously cutting said slots of two adjoined polygons as a single slot.

5. The method as specified in claim 1 wherein said adjoining edge portions are stitched together by applying lock stitching to the innermost adjoined edge portions.

6. The method as specified in claim 1 wherein the polygon is a hexagon.

7. A method for manufacturing a book cover from a sheet of pliant material comprising the steps of: cutting a laterally-elongated hexagon from a sheet of said pliant material, cutting a slot in each laterally-elongated side in a substantially bisecting relation therewith, the slots extending at right angles to the respective elongated sides, and extending a predetermined distance into the hexagon; creating laterally-extended fold lines and end fold lines orthogonal thereto to form a rectangle having rectangle corners thereof coincident with the sides of the hexagon, folding inward the portions of the hexagon that are located external to the rectangle to bring the edge portions of the hexagon into mutually adjoining relation, wherein said portions of the hexagon that are located external to the rectangle include a lateral triangular panel, a top panel having at least four sides, and a bottom panel having at least four sides, and securing said adjoining edge portions together, wherein a bottom edge of said top panel is joined to a top edge of said bottom panel, a side edge of said top panel is joined to a side edge of said lateral triangular panel, and a side edge of said bottom panel is joined to a side edge of said lateral triangular panel to thus form an access slot and two pockets, wherein each pocket comprises a lateral triangular panel, a top panel having at least four sides, and a bottom panel having at least four sides and wherein said access slot provides access through which interiors of said front cover pocket and said back cover pocket can be accessed.

* * * * *